United States Patent [19]

Gibbons

[11] Patent Number: 4,993,085

[45] Date of Patent: Feb. 19, 1991

[54] POWER ASSISTED TOILET SEAT

[75] Inventor: Frank B. Gibbons, Mesa, Ariz.

[73] Assignees: Harry D. Lockhart; Mackie G. Lockhard, both of Russell, Ky.

[21] Appl. No.: 416,473

[22] Filed: Oct. 3, 1989

[51] Int. Cl.[5] ..... A47K 13/10; A47K 13/00

[52] U.S. Cl. ..... 4/251; 4/237

[58] Field of Search ..... 4/251, 237, 566, 254; 297/DIG. 10, 327, 330

[56] References Cited

U.S. PATENT DOCUMENTS 3,473,174 10/1969 Cool ..... 4/251

3,925,833 12/1975 Hunter ..... 4/251

*Primary Examiner*—Henry J. Recla

*Assistant Examiner*—David J. Walczak

*Attorney, Agent, or Firm*—Fleit, Jacobson, Cohn, Price, Holman & Stern

[57] ABSTRACT

A power assisted toilet seat including a toilet seat lifting and tilting structure in which the seat is disposed between and below a pair of armrests for pivotal movement about a generally horizontal transverse axis with a power assist means being provided to move the toilet seat in a path closely approximating the movement of the hips, buttocks, thighs, knees and lower legs which occurs when a person moves between a standing position and a sitting position with the contacting relationship between the user and the seat and between the user and the armrests providing a stable and secure relationship between the user and the power assisted toilet seat during movement of the toilet seat and armrests as the user moves between a standing position and a sitting position. The power assist means includes a pair of fluid power operated lift assemblies interconnecting a base with the seat and armrests and a pair of fluid power operated piston and cylinder assemblies interconnecting the rearward end of the toilet seat and the lift assemblies for the seat to tilt the rearward portion of the toilet seat upwardly to an inclined position as the toilet seat is lifted and to return the toilet seat back to a horizontal position as the toilet seat is lowered.

8 Claims, 2 Drawing Sheets

POWER ASSISTED TOILET SEAT

BACKGROUND OF THE INVENTION

1. Field of Invention

The present invention relates to a power assisted toilet seat including a toilet seat lifting and tilting structure in which the seat is disposed between and below a pair of armrests for pivotal movement about a generally horizontal transverse axis with a power assist means being provided to move the toilet seat in a path closely approximating the movement of the hips, buttocks, thighs, knees and lower legs which occurs when a person moves between a standing position and a sitting position with the contacting relationship between the user and the seat and between the user and the armrests providing a stable and secure relationship between the user and the power assisted toilet seat during movement of the toilet seat and armrests as the user moves between a standing position and a sitting position. The power assist means includes a pair of fluid power operated lift assemblies interconnecting a base with the seat and armrests for lifting the seat and armrests in an inclined path from a position with the seat immediately above the upper open end of a toilet commode to an elevated position above and slightly forwardly of the toilet commode combined with another fluid power operated piston and cylinder assembly interconnecting the rearward end of the toilet seat and the lift assemblies for the seat to tilt the rearward portion of the toilet seat upwardly to an inclined position as the toilet seat is lifted and to return the toilet seat back to a horizontal position as the toilet seat is lowered thereby moving the toilet seat in a geometric path closely approximating the movement of the human body when moving between a sitting and standing position in relation to a toilet seat thereby assisting a user of the toilet during movement between a standing and sitting position. The water pressure available to supply water to the water storage tank positioned above the toilet commode is utilized to power the Lift assemblies and the piston and cylinder assemblies through a control valve located at one of the armrests to enable handicapped users and the like to effectively gain access to a commode and remove themselves from the commode without assistance by attendants thereby enhancing the capability of handicapped persons to use a toilet.

2. Information Disclosure Statement

It is well known that individuals having certain handicaps and especially elderly individuals have trouble using the toilet since it is difficult to move between a standing and sitting position in relation to a conventional toilet seat. Thus, it frequently is necessary for such a person to obtain the assistance of another person when moving between a sitting and standing position. Efforts have been made to provide lift devices to assist an individual in moving between a standing position and a sitting position with such devices including mechanical linkages, fluid power lift devices and the like. The following U.S. patents relate to this field of endeavor.

U.S. Pat. Nos.:

2,442,303
3,458,872
3,473,174
3,925,833
4,185,335
4,777,671

While lift assist devices are disclosed in the above listed patents, they do not disclose the specific structure of the present invention by which the toilet seat can be effectively elevated and moved upwardly and downwardly in an inclined path while at the same time pivoting the rearward portion of the seat between a generally horizontal position and an upwardly inclined position in which the rearward end of the toilet seat is positioned substantially above the forward end thereby moving the toilet seat in a path closely approximating the geometry of movement of the human anatomy when moving between a standing and sitting position thereby providing a firm, stable and adjustable power assist device that will effectively support the user during all phases of movement between the sitting and standing positions.

SUMMARY OF THE INVENTION

An object of the invention is to provide a power assisted toilet seat to move a toilet seat in a geometical path approximating the actual path of movement of the hip, buttocks, thighs, knees and upper leg portions of a person moving between a sitting position and a standing position to assist a person in using a toilet without the assistance of another person.

Another object of the invention is to provide a toilet seat lifting and inclining structure in the form of fluid pressure operated piston and cylinder lift assemblies arranged to support the seat and a pair of armrests for movement between a lowered and elevated position along an inclined vertical path extending forwardly and upwardly from the toilet commode with the rearward end of the seat also being tilted upwardly as the seat is elevated thereby moving the seat to an inclined position as it is moved between a lowered and elevated position thereby closely following the path of movement of the components of the human anatomy which are used when moving between a generally horizontal position and a generally vertical position.

A further object of the invention is to provide a power assisted toilet seat which includes a supporting base that may be positioned in straddling relation to the base of a commode to enable the device to be portable or permanently anchored to a floor surface or other supporting surface to enable the device to be used with an existing commode structure with the present invention including a toilet seat having the shape, size and strength characteristics of a conventional toilet seat with the power assist device utilizing available fluid pressure from the water system communicated with the commode tank thereby facilitating the use of the present invention with existing commodes.

Still another object of the invention is to provide a power assisted toilet seat which includes a toilet seat and armrests which move between a generally horizontal position overlying the upper end of a commode bowl to an elevated and upwardly inclined position to simulate the natural movement of the human anatomy when moving between a standing and sitting position in which the knee joint rotates away from and to the front of the center of gravity of the body and on a radius from the ankle and the hip joint moves down and to the back of the center of gravity of the body with the rotation of the seat allowing for loading the weight of the user on the buttocks to be more evently distributed rather than being concentrated on the mid thigh area with the speed and degree of movement being controlled and influenced by the individual using the device to cushion or soften the continuous changes in position due to the fluid pressure operated piston and cylinder assemblies.

A still further object of the invention is to provide a power assisted toilet seat which is relatively simple in construction, effective, safe and stable in operation and usable as a portable or permanently installed unit which is efficient in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
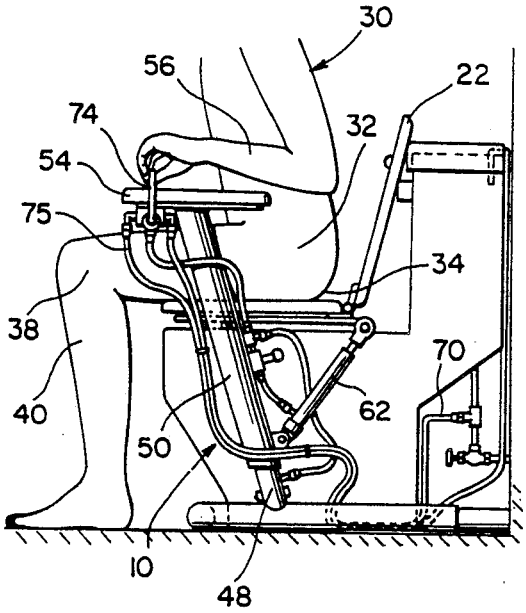
FIG. 1 is a side elevational view of the power assisted toilet seat of the present invention illustrating its relationship to the commode and the user when the toilet seat is positioned immediately above the commode bowl.

Referring now specifically to the drawings, the reference numeral 10 generally designates the power assisted toilet seat of the present invention that is associated with a conventional commode bowl 12 having the usual rim 14 at its upper end and a water tank 16 positioned above and in communication with the commode bowl 12 with the tank 16 being provided with a water supply line 18 provided with the usual valve 17 to control flow of water to the tank 16. The power assisted toilet seat 10 includes a toilet seat 20 closely simulating existing toilet seats with the rearward end of the toilet seat 20 including a lid 22 attached thereto and the toilet seat is connected to a subframe 24 which supports the toilet seat to enable the seat and lid to be pivoted to an upwardly and rearwardly inclined position when oriented at the upper edge of the commode bowl 12 in a conventional manner. The subframe 24 is hingedly connected to a pair of lift assemblies generally designated by the numeral 26 at a point generally adjacent the forward edge of the toilet seat but spaced rearwardly therefrom for pivotal movement of the subframe 24 and toilet seat 20 about a transverse horizontal axis with a pair of fluid pressure operated piston and cylinder assemblies 28 interconnecting the rearward edge of the subframe 24 and the lift assemblies 26 to incline the toilet seat 20 between a generally horizontal position when it is at its lowered position just above the top edge of the commode bowl 12 and an upwardly and rearwardly inclined almost vertical position when the toilet seat 20 is in its uppermost position to provide contact with and supporting engagement with a person using the toilet generally designated by the reference numeral 30 with the toilet seat generally following the geometric path of movement of the hips 32, buttocks 34, thighs 36, knees 38 and lower leg portions 40 about the ankles 42 which occurs during movement between a sitting and standing position.

The lift assemblies 26 include a base 44 in the form of a U-shaped tubular member which may straddle the commode bowl 12 to render the device portable by virtue of its being easily positioned on the floor surface 46 and moved rearwardly into straddling relation to the lower end of the commode bowl 12 or the base 44 may be a base plate permanently anchored to the floor 46 by suitable fasteners. Rigidly affixed to the base 44 is a pair of lower rigid tubular members 48 which extend upwardly and forwardly in an inclined relation to the commode 12 with the upper ends thereof being slidably received in tubular members 50 rigidly connected to a pair of armrests 54. A fluid pressure operated piston and cylinder assembly 51 is disposed internally of the tubular members 48 and 50 for extending and permitting retraction of the tubular members 48 and 50. The subframe 24 for the toilet seat 20 is hinged to the tubular members 50 by a pivot pin 52 located below the upper end of the tubular members 50 for pivotal movement of the toilet seat 20 and the subframe 24 about a transverse, horizontal axis. Attached to the upper end of each of the tubular members 50 is the armrest 54 which are horizontally oriented and extend both forwardly and rearwardly from the upper end of the tubular members 50 to provide stable support for the arms 56 of the user including a point of contact between the elbow 58 and the armrest 54 which may be a cusioned member having a length extending for a substantial portion of the length of the arm between the elbow 58 and an area adjacent the wrist 60.

Each fluid pressure operated piston and cylinder assembly 28 includes a lower cylinder 62 pivotally attached to the lower end portion of the tubular member 50 by a pivotal connection 64 and an upper piston rod 66 pivotally connected to the subframe 24 by a pivotal connection 68 for extension and retraction as the lift assemblies 26 are expanded and retracted for lifting and lowering the seat 20 with the piston and cylinder assembly 28 tilting the rear portion of the seat 20 upwardly about pivot pins 52 as the seat is elevated and arriving at a final position of almost vertical orientation for the seat to engage the buttock area of the user 30 when in a standing position as well as when in a sitting position.

In order to power the toilet seat, a water supply line 70 is connected to the water supply line for the commode and may be provided with a valve with the water supply line being connected to the lower end of the cylinder of the piston and cylinder 51 and to the lower end of cylinder 62 through a control valve 72 having an operating handle 74 extending upwardly therefrom by which fluid pressure can be admitted to the lower end of the cylinder of the piston and cylinder assembly 50 and the lower end of the cylinder 62 and drained therefrom back to a suitable return line 75 extending to the sewer pipe below the commode or to any other drain line or back to the commode tank 16.

Figure 2:
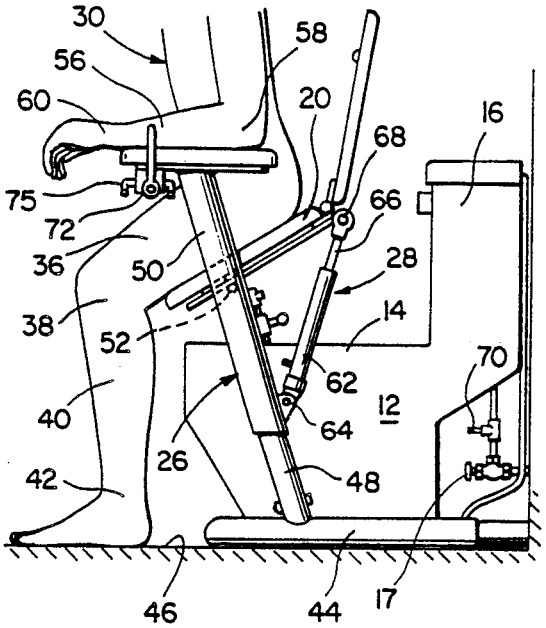
FIG. 2 is a side elevational view similar to FIG. 1 but illustrating the components in an intermediate position.
Figure 3:
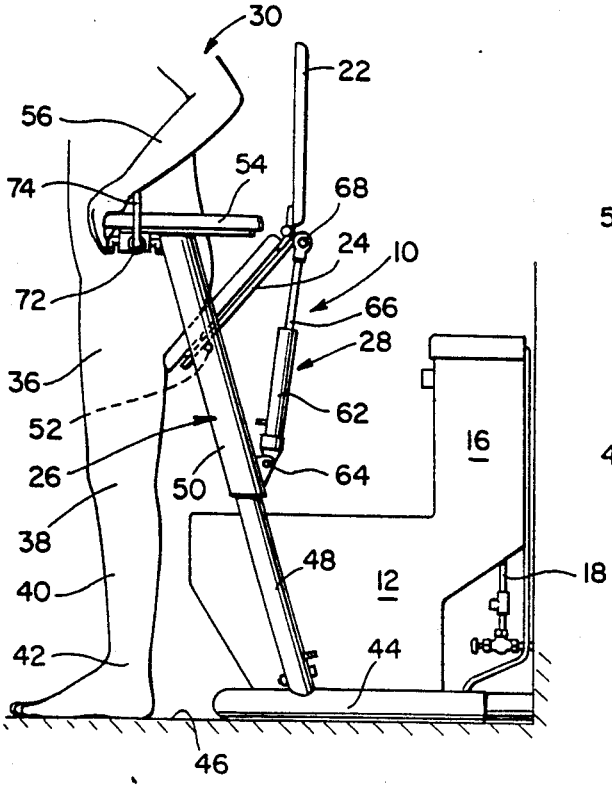
FIG. 3 is a side elevational view similar to FIG. 1 but illustrating the components in the fully elevated position with the toilet seat inclined to engage a user when in the standing position.
Figure 4:
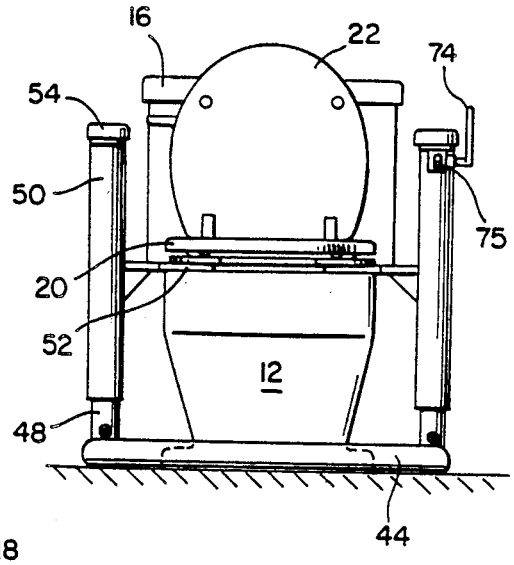
FIG. 4 is a front elevational view of the power assisted toilet seat.
Figure 5:
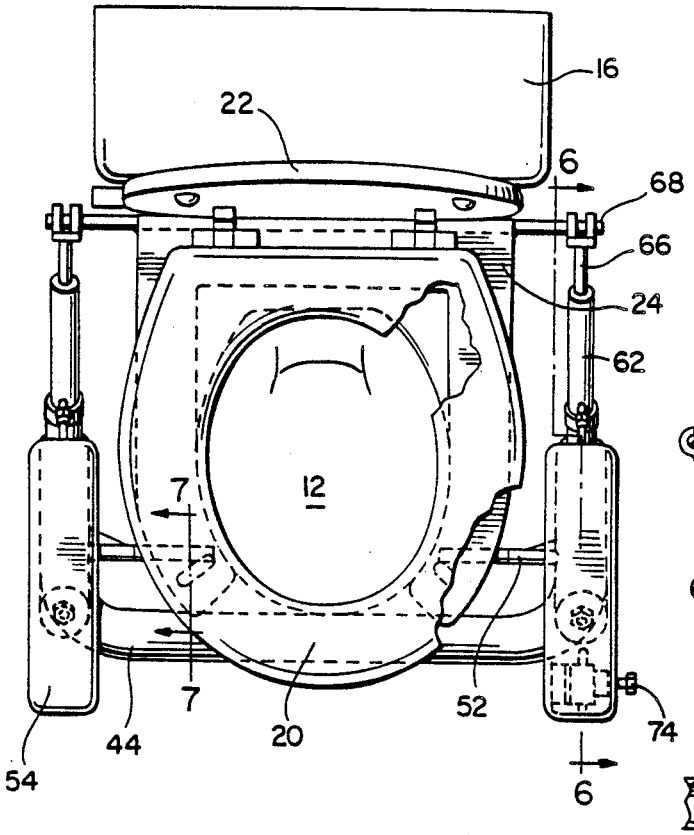
FIG. 5 is a top plan view of the invention.
Figure 6:
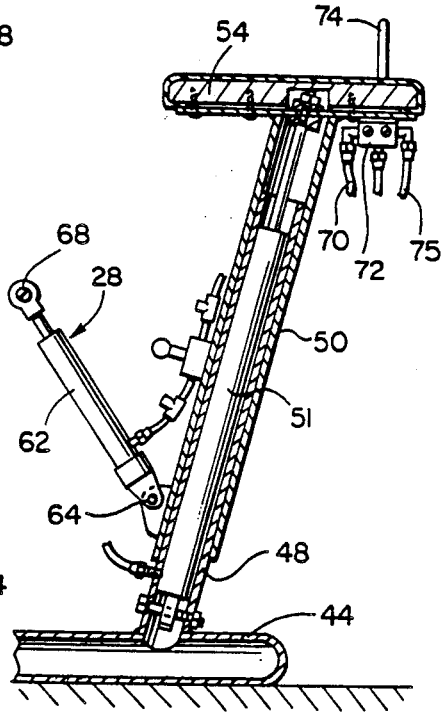
FIG. 6 is a detailed sectional view taken substantially upon a plane passing along section line 6—6 on FIG. 5 illustrating further structural details of the invention.
Figure 7:
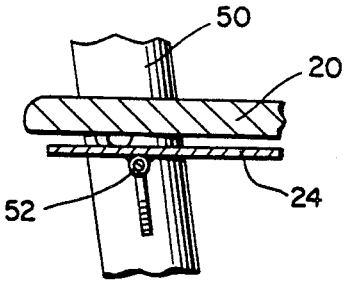
FIG. 7 is a detailed sectional view taken along section line 7—7 on FIG. 5 illustrating the connection between the power assist device and the toilet seat.
Figure 8:
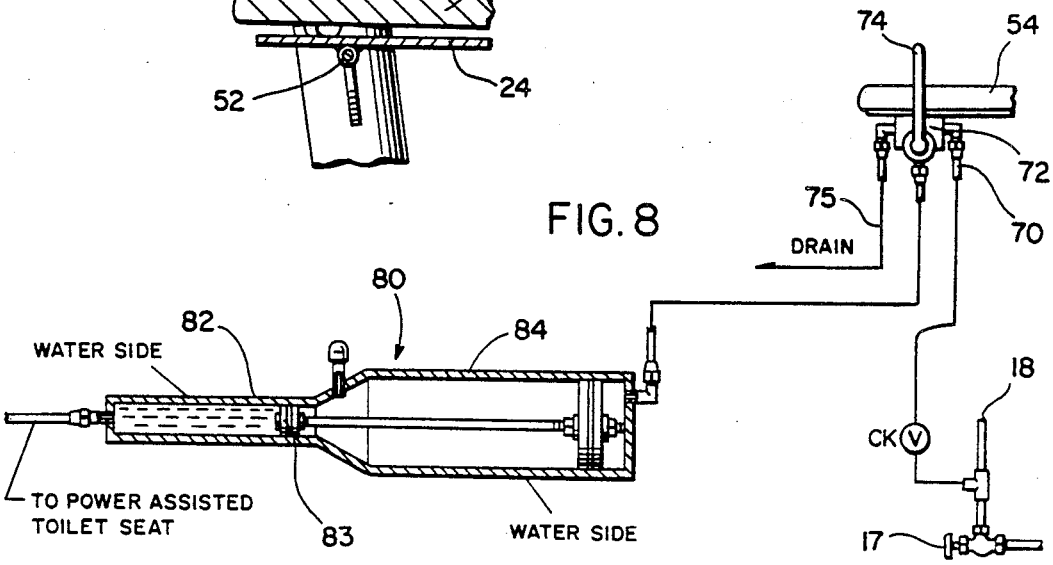
FIG. 8 is a schematic view illustrating an alternative power arrangement to provide increased force from existing water pressure and isolating existing water from the piston and cylinder assemblies.

The movement of the seat 20 between its extreme positions is illustrated in FIGS. 1-3. Movement of the seat can be stopped at any point in the cycle of operation by moving the lift control valve to the closed position with the lift control valve including an adjustable flow to enable the individual using the device to regulate the speed of movement of the seat and the speed of angular movement of the seat between tilted and horizontal positions.

In situations where the water pressure may not be adequate or where the water may cause deposits on the interior of a cylinder, an oil/water power device 80 may be used which includes an oil cylinder 82 with a piston 83 therein with these components being of smaller diameter and communicated with the piston and cylinder assemblies 26 and 28 together with a larger diameter water cylinder and piston assembly 84 connected with the water supply thereby providing an increase in power and isolating the piston and cylinder lift and tilting assemblies from a water supply that may permit deposits to collect on a water powered piston and cylinder assembly. The small piston and cylinder having a diameter of 3.5" and a larger piston and cylinder assembly having a diameter of 5" would supply the required volume of water to the system and multiply the force by a 2–1 ratio thus enabling use of the device even where the water may have mineral deposits and the like which would reduce the longevity of the piston and cylinder assemblies prior to cleaning being necessary and provide adequate force to lift the individual even if the water supply pressure may be low.

While the piston and cylinder assembly 51 for lifting the seat has been illustrated as incorporated into a pair of telescopic members 48 and 50, it is pointed out that the piston and cylinder assemblies for lifting the seat may be positoned externally of a pair of telescopic members so that the telescopic members only serve as guides for the movement of the seat with suitable brackets being positioned on the two telescopic members to connect a piston and cylinder assembly therebetween so that extension and retraction of the piston and cylinder assemblies will extend and retract the telescopic members. In addition, in some installations, the commode bowl itself could be provided with lateral protrusions or extensions having the lift piston and cylinders incorporated therein to provide a built-in look thereby eliminating the addition of a base unit and rendering the entire assembly somewhat more compact and neat and attractive in appearance.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A power assisted toilet seat comprising a pair of vertically extending, inclined lift assemblies adapted to be oriented on opposite sides of a commode, a toilet seat mounted between the lift assemblies for movement along a vertically inclined path, piston and cylinder means interconnecting the toilet seat and the lift assemblies for moving the toilet seat in an inclined path for pivoting the rearward portion of the toilet seat upwardly about the connection between the toilet seat and lift assemblies for moving the toilet seat in an inclined path thereby inclining the toilet seat as it is moved upwardly in an inclined path to an upwardly inclined position for lifting and supporting a user of the toilet when moving between a sitting position and a standing position and manual control means accessible to a user of the toilet seat to enable control of the lifting and tilting functions of the toilet seat, a pair of armrests mounted on said lift assemblies above the toilet seat to provide a stable support for a user, said control means being mounted on one of said armrests, each of said lift assemblies for moving the toilet seat in a vertically inclined path including an upper tubular member attached rigidly to an armrest and depending therefrom in an inclined manner, a lower tubular member telescopically received in the upper tubular member and stationarily supported, and a fluid pressure operated piston and cylinder positioned within each of said upper and lower tubular members to move the toilet seat generally vertically in an inclined path when fluid pressure is introduced between the cylinder and piston.

2. The structure as defined in claim 1 together with base means supporting the lower ends of the lower tubular members in a stationary manner.

3. The structure as defined in claim 2 wherein said base means includes a generally U-shaped base having spaced parallel legs straddling a commode from the front thereof with the lower ends of the lower tubular members being rigidly affixed to the base along opposite sides of the commode.

4. The structure as defined in claim 3 wherein said piston and cylinder means for pivoting the rear end of the toilet seat includes a fluid pressure operated piston and cylinder interconnecting the rearward end of the toilet seat and each of the upper tubular members rigidly affixed to the armrests for pivoting the rearward end of the toilet seat upwardly as the seat is elevated.

5. The structure as defined in claim 4 together with a source of pressurized fluid communicated with the piston and cylinders through said control means.

6. The structure as defined in claim 5 wherein said fluid power source includes a water supply line adapted to be communicated with a toilet commode tank.

7. The structure as defined in claim 5 wherein the movement of the seat closely approximates the geometric movement of the hips, buttocks, thighs, knees and lower legs of a person using the device when moving between a sitting and standing position.

8. A power assisted toilet seat comprising a supporting base, a toilet seat positioned above the supporting base and adapted to be positioned closely above a commode bowl, and a pair of toilet seat lift and tilt assemblies connecting the toilet seat to the base for moving the toilet seat vertically and pivoting the toilet seat about a transverse axis, each of said lift and tilt assemblies including a fluid pressure operated piston and cylinder lift assembly and a fluid pressure operated piston and cylinder tilt assembly, said piston and cylinder lift assemblies being fixed to said base and having an opposite end portion movable with respect to said base and having one end portion connected pivotally to the toilet seat, said piston and cylinder tilt assemblies having one end pivotally connected to said toilet seat rearwardly of said opposite ends of said piston and cylinder lift assemblies and an opposite end pivotally connected to said piston and cylinder lift assemblies and movable therewith, said toilet seat being movable between a lowered generally horizontal position closely above a commode bowl to an elevated position in generally upwardly inclined relation above the commode bowl.

* * * * *